US010193227B2

(12) United States Patent
Chang et al.

(10) Patent No.: US 10,193,227 B2
(45) Date of Patent: Jan. 29, 2019

(54) WAVEGUIDE TRANSITION STRUCTURE FOR RECEIVING SATELLITE SIGNALS

(71) Applicant: MICROELECTRONICS TECHNOLOGY, INC., Hsinchu (TW)

(72) Inventors: Kuotien Chang, Hsinchu (TW); Yenfen Lin, Hsinchu (TW); Yu-Chih Wu, Hsinchu (TW)

(73) Assignee: MICROELECTRONICS TECHNOLOGY, INC., Hsinchu (TW)

( * ) Notice: Subject to any disclaimer, the term of this patent is extended or adjusted under 35 U.S.C. 154(b) by 219 days.

(21) Appl. No.: 15/234,517

(22) Filed: Aug. 11, 2016

(65) Prior Publication Data

US 2018/0048066 A1 Feb. 15, 2018

(51) Int. Cl.

| | |
|---|---|
| ***H01P 5/00*** | (2006.01) |
| ***H01Q 1/38*** | (2006.01) |
| ***H01Q 5/55*** | (2015.01) |
| ***H01Q 9/04*** | (2006.01) |
| ***H01Q 13/02*** | (2006.01) |
| ***H01Q 19/17*** | (2006.01) |

(52) U.S. Cl.

CPC ..... *H01Q 5/55* (2015.01); *H01P 5/00* (2013.01); *H01Q 1/38* (2013.01); *H01Q 9/0421* (2013.01); *H01Q 13/02* (2013.01); *H01Q 19/17* (2013.01)

(58) Field of Classification Search

CPC ..... H01Q 13/025; H01Q 13/02; H01Q 5/55; H01Q 9/0421; H01P 5/02; H01P 5/107; H01P 3/12–3/123; H01P 1/161

See application file for complete search history.

(56) References Cited

U.S. PATENT DOCUMENTS 6,111,547 A 8/2000 Gau et al.
6,181,293 B1 * 1/2001 Muhlhauser ..... H01Q 3/2658 343/753
6,552,636 B1 * 4/2003 Yuanzhu ..... H01P 1/02 333/21 A (Continued)

FOREIGN PATENT DOCUMENTS

CN 103297071 A 9/2013
CN 102638300 B 9/2014

(Continued)

OTHER PUBLICATIONS

Machine translation of CN-103297071A.*

(Continued)

*Primary Examiner* — Howard Williams
(74) *Attorney, Agent, or Firm* — Muncy, Geissler, Olds & Lowe, P.C.

(57) ABSTRACT

The present disclosure provides a waveguide transition structure for receiving satellite signals, which can be implemented in a low noise block down-converter. In some embodiments of the present disclosure, the low noise block down-converter includes a feed horn structure having at least a first waveguide extending along a first direction, a housing having at least a second waveguide extending along a second direction and communicating with the first waveguide, and a circuit board positioned within the housing. The second direction is substantially not in parallel to the first direction. The circuit board has a receiving pin configure to receive microwave signals propagating in the second waveguide.

15 Claims, 14 Drawing Sheets

(56) References Cited

U.S. PATENT DOCUMENTS

| | | | | |
|---|---|---|---|---|
| 2004/0036661 | A1 | 2/2004 | Hanlin et al. | |
| 2004/0227597 | A1 | 11/2004 | Chang et al. | |
| 2014/0266954 | A1 | 9/2014 | Haziza et al. | |
| 2017/0025726 | A1* | 1/2017 | Gomi | H01P 1/025 |
| 2017/0179597 | A1* | 6/2017 | Parekh | H01Q 5/364 |

FOREIGN PATENT DOCUMENTS

| | | | |
|---|---|---|---|
| EP | 3282516 | A1 * | 2/2018 |
| JP | 2000228601 | A | 8/2000 |

OTHER PUBLICATIONS

Office action dated Feb. 22, 2018 from the Taiwan counterpart application 105125585.
English abstract translation of the office action dated Feb. 22, 2018 from the Taiwan counterpart application 105125585.
Office action and search report dated Feb. 15, 2017 from the European patent office for counterpart EP application 16183814.9.

* cited by examiner

WAVEGUIDE TRANSITION STRUCTURE FOR RECEIVING SATELLITE SIGNALS

TECHNICAL FIELD

The present disclosure relates to a waveguide transition structure for receiving satellite signals, and more particularly to a low noise block down-converter with a waveguide transition structure for receiving satellite signals, wherein the low noise block down-converter includes a housing with a waveguide from propagating microwave signals along a direction different from a feed horn on the housing.

DISCUSSION OF THE BACKGROUND

Satellite communications require equipment such as ground stations, low noise block down converters, transmission cables, and modulators/demodulators. The ground station receives microwave signals from satellites; the low noise block down converter amplifies the received microwave signals and converts the amplified microwave signals into intermediate frequency signals; and the transmission cables transmit the intermediate signals to the modulator/demodulator.

Generally, the low noise block down converter may include a microwave circuit and an intermediate circuit electrically connecting to the microwave circuit. The microwave circuit receives microwave signals, converts the microwave signals to intermediate signals, and transmits the intermediate signals to the intermediate circuit.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY

One aspect of the present disclosure provides a low noise block down-converter with a waveguide transition structure for receiving satellite signals, wherein the low noise block down-converter includes a housing with a waveguide from propagating microwave signals along a direction different from a feed horn on the housing.

Some embodiments of the present disclosure provides a low noise block down-converter with a waveguide transition structure for receiving satellite signals, and the low noise block down-converter comprises a feed horn structure having at least a first waveguide extending along a first direction, a housing having at least a second waveguide extending along a second direction and communicating with the first waveguide, wherein the second direction is substantially not in parallel to the first direction; and a circuit board positioned within the housing, wherein the circuit board has a receiving pin configure to receive microwave signals propagating in the second waveguide.

Some embodiments of the present disclosure provides an outdoor unit comprises a dish antenna and a low noise block converter with a waveguide transition structure for receiving satellite signals, wherein the low noise block converter is positioned at a focus point of the dish antenna. The low noise block converter comprises a feed horn structure having at least a first waveguide extending along a first direction, a housing having at least a second waveguide extending along a second direction and communicating with the first waveguide, wherein the second direction is substantially not in parallel to the first direction; and a circuit board positioned within the housing, wherein the circuit board has a receiving pin configure to receive microwave signals propagating in the second waveguide.

In some embodiments of the present disclosure, the housing comprises: a base having an upper surface, a bottom surface, and a depression dented from the bottom surface towards the upper surface, and a metal sheet substantially covering the depression to implement the second waveguide.

In some embodiments of the present disclosure, the metal sheet has an aperture exposing at least a portion of the second waveguide, the circuit board has a slot corresponding to the aperture, and the receiving pin extends into the slot.

In some embodiments of the present disclosure, the housing comprises a first transforming structure configured to guide the microwave signals from the first waveguide to the second waveguide.

In some embodiments of the present disclosure, the first transforming structure has a multi-step member.

In some embodiments of the present disclosure, the first transforming structure has a first portion in the feed horn structure and a second portion in the depression.

In some embodiments of the present disclosure, the housing comprises a second transforming structure configured to guide the microwave signals from the second waveguide to the circuit board.

In some embodiments of the present disclosure, the second transforming structure has a multi-step member.

In some embodiments of the present disclosure, the housing comprises a base having an upper surface, a bottom surface, and a depression dented from the bottom surface towards the upper surface; wherein the circuit board comprises a metal layer at least covering a portion the depression to implement at least a portion of the second waveguide.

In some embodiments of the present disclosure, the housing comprises a metal sheet covering at least covers a portion the depression to implement at least a portion of the second waveguide, wherein the metal sheet and the metal layer substantially cover the depression.

In some embodiments of the present disclosure, the housing comprises: a base having an upper surface, a bottom surface, and a first depression dented from the bottom surface towards the upper surface; and a metal part substantially covering the first depression to implement the second waveguide, wherein the metal part has a second depression communicating with the first depression.

In some embodiments of the present disclosure, the circuit board is positioned between the base and the metal part.

In some embodiments of the present disclosure, the metal part has a first slanted plane configured to guide the microwave signals from the first waveguide to the second waveguide.

In some embodiments of the present disclosure, the metal part has a second slanted plane configured to guide the microwave signals from the second waveguide to the circuit board.

In some embodiments of the present disclosure, the receiving pin extends into the second waveguide.

In some embodiments of the present disclosure, the second waveguide has a first end communicating with the first waveguide, and the circuit board is positioned substantially without overlapping the first end.

In some embodiments of the present disclosure, the second waveguide has a second end communicating with the circuit board, and the circuit board substantially overlaps the second end.

In some embodiments of the present disclosure, the first waveguide has a bottom communicating with the second waveguide, and the housing includes a first depression extending from a first side of the bottom and a second depression extending from a second side of the bottom.

In some embodiments of the present disclosure, the feed horn structure comprises a first feed horn and a second feed horn disposed in parallel to the first feed horn.

In a comparative low noise block down-converter, the feed horns need to be separated by a certain distance and discrete electronic devices are used to implement the microwave receiving system. The comparative low noise block down-converter uses a circuit board with a large layout size (space) to comply with the positions of the separated feed horns and to position the discrete electronic devices. It is well known in the art that the circuit board for implementing the microwave receiving system is very expensive, and thus the overall cost of the comparative low noise block down-converter is very expensive as well.

As the industrial tends to implement the functions of several discrete electronic devices into a single integrated circuit device, the low noise block converter with a waveguide transition structure for receiving satellite signals of the present disclosure uses the waveguide in the housing in order to guide the microwave signals from the feed horn to the input port of the circuit board such as the input port of the low noise amplifier. As a result, an integrated circuit device implementing the function of several discrete electronic devices can be used on the circuit board, thus allowing the low noise block converter with a waveguide transition structure for receiving satellite signals of the present disclosure to reduce the layout size of the circuit board and, in turn, dramatically reducing the cost of the low noise block down-converter.

The foregoing has outlined rather broadly the features and technical advantages of the present disclosure in order that the detailed description of the disclosure that follows may be better understood. Additional features and advantages of the disclosure will be described hereinafter, which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "some embodiments," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

The present disclosure is directed to a low noise block converter with a waveguide transition structure for receiving satellite signals, wherein the low noise block down-converter includes a housing with a waveguide from propagating microwave signals along a direction different from a feed horn on the housing. In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
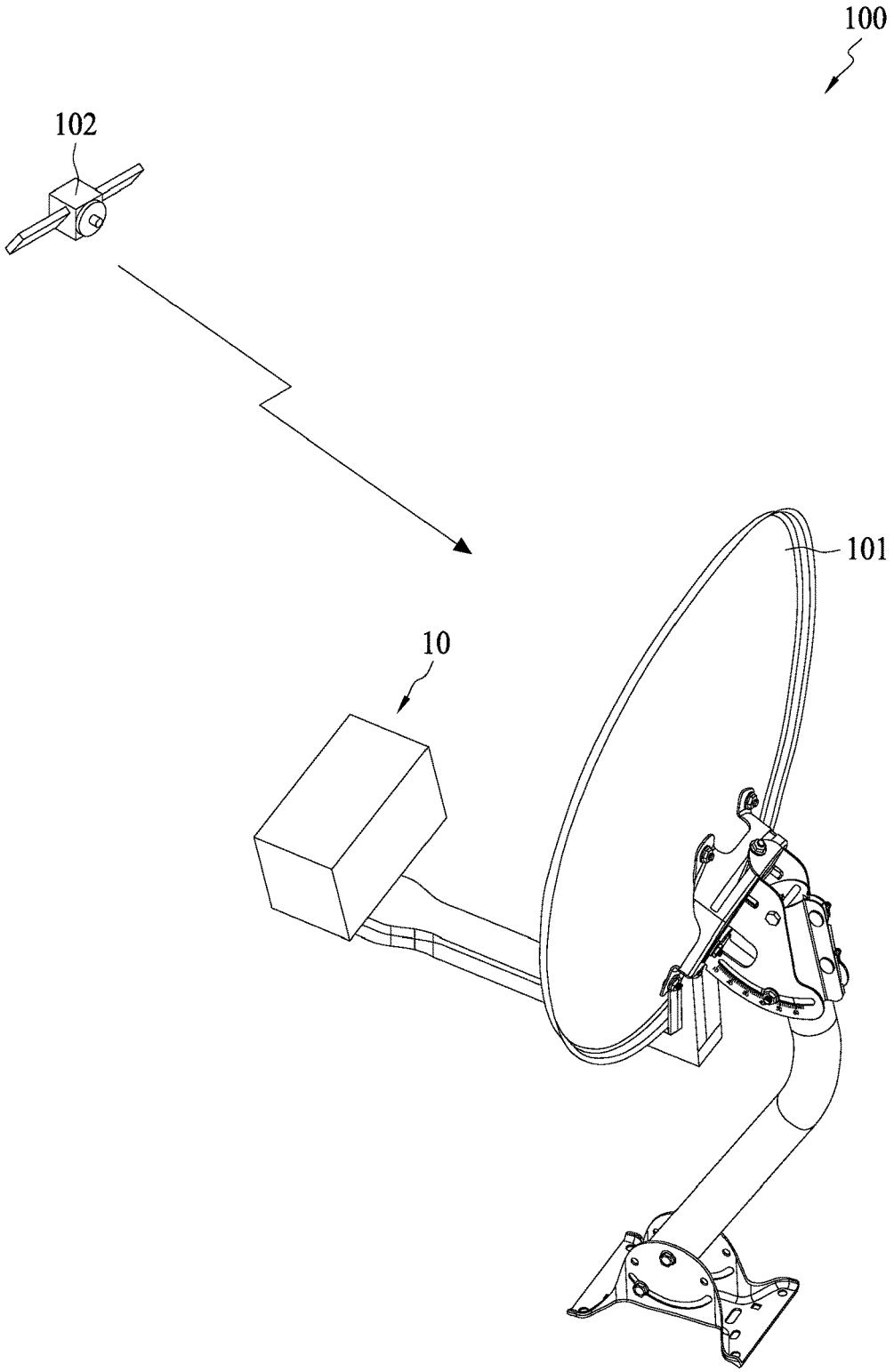
FIG. 1 shows a three-dimensional view of an outdoor unit according to some embodiments of the present disclosure.

FIG. 1 illustrates a three-dimensional view of an outdoor unit 100 according to some embodiments of the present disclosure. In some embodiments of the present disclosure, the outdoor unit 100 comprises a dish antenna 101 for receiving microwave signals from a satellite 102 and a low noise block (LNB) down-converter 10 with a waveguide transition structure for receiving satellite signals, wherein the LNB down-converter 10 is positioned at a focus point of the dish antenna 101. In some embodiments of the present disclosure, the LNB down-converter 10 receives the microwave signals from the satellite antenna 102, converts the received microwave signals into an intermediate frequency (IF), and amplifies the IF signals to acceptable output levels. Furthermore, the LNB down-converter 10 removes unnecessary components and noise from a received satellite signals.

Figure 2:
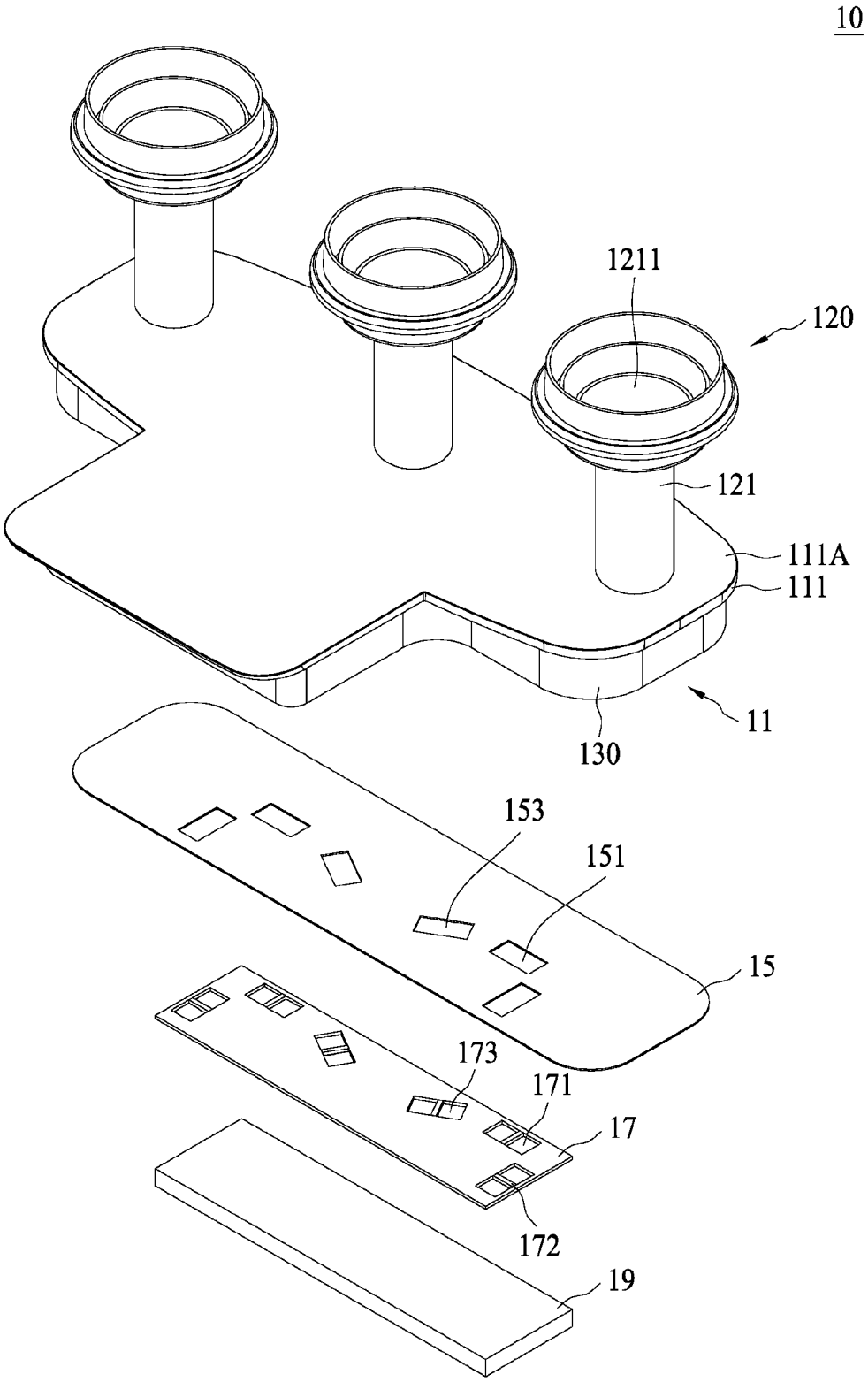
FIG. 2 and FIG. 3 illustrate disassembled views of the low noise block down-converter from the top side and the bottom side, respectively, according to some embodiments of the present disclosure.
Figure 3:
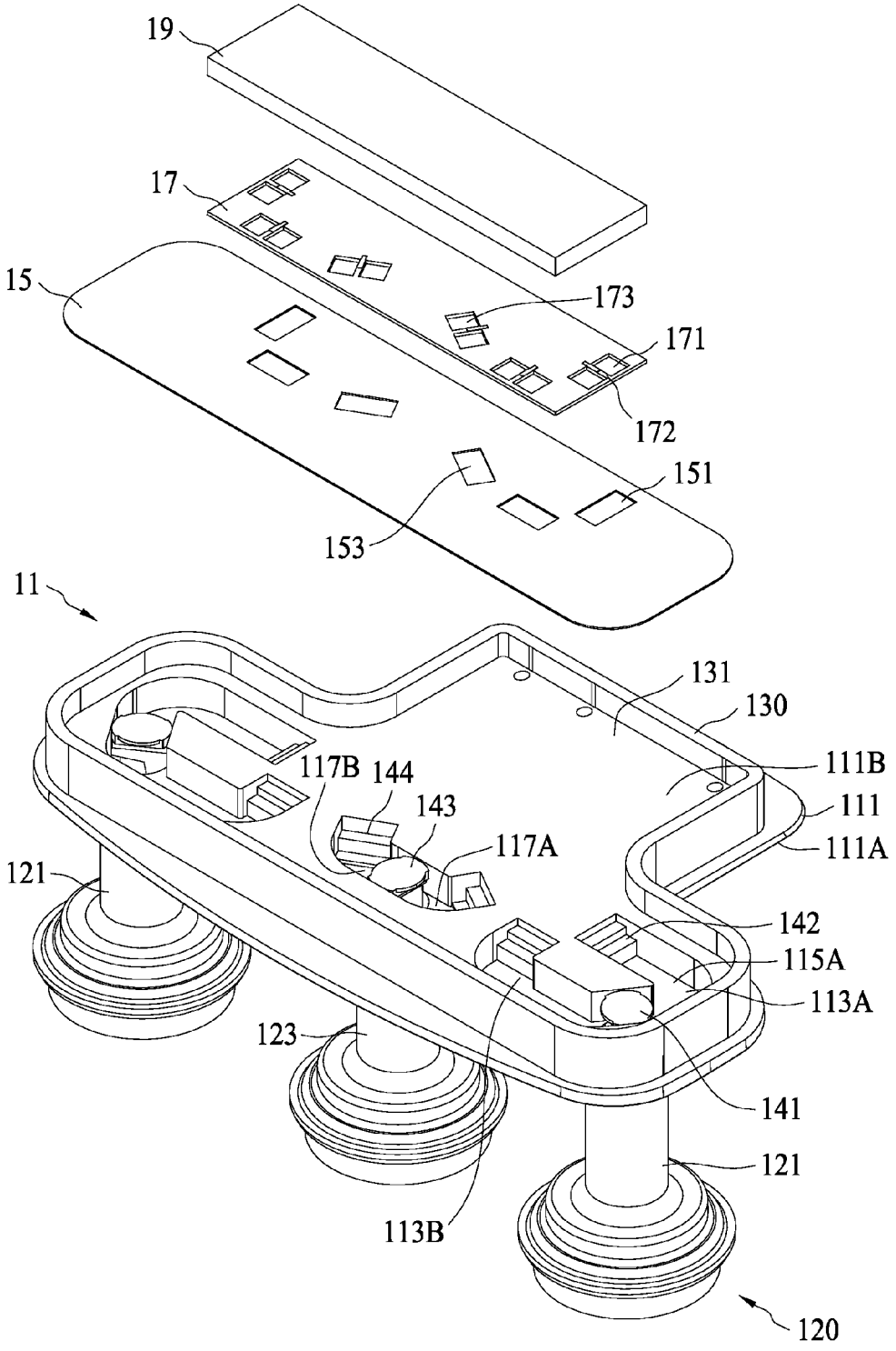
Figure 4:
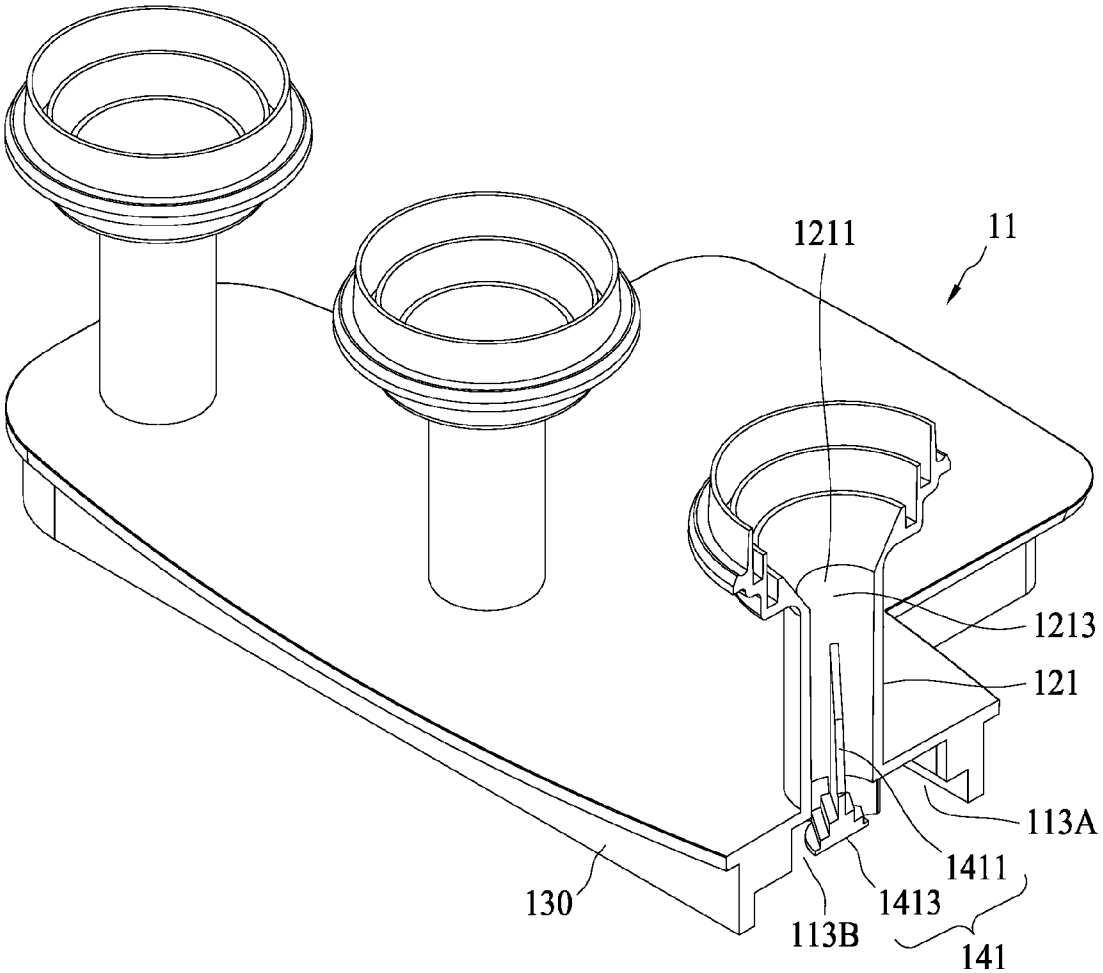
FIG. 4 illustrates a cross-sectional full view of the housing in FIG. 2 along one direction according to some embodiments of the present disclosure.
Figure 5:
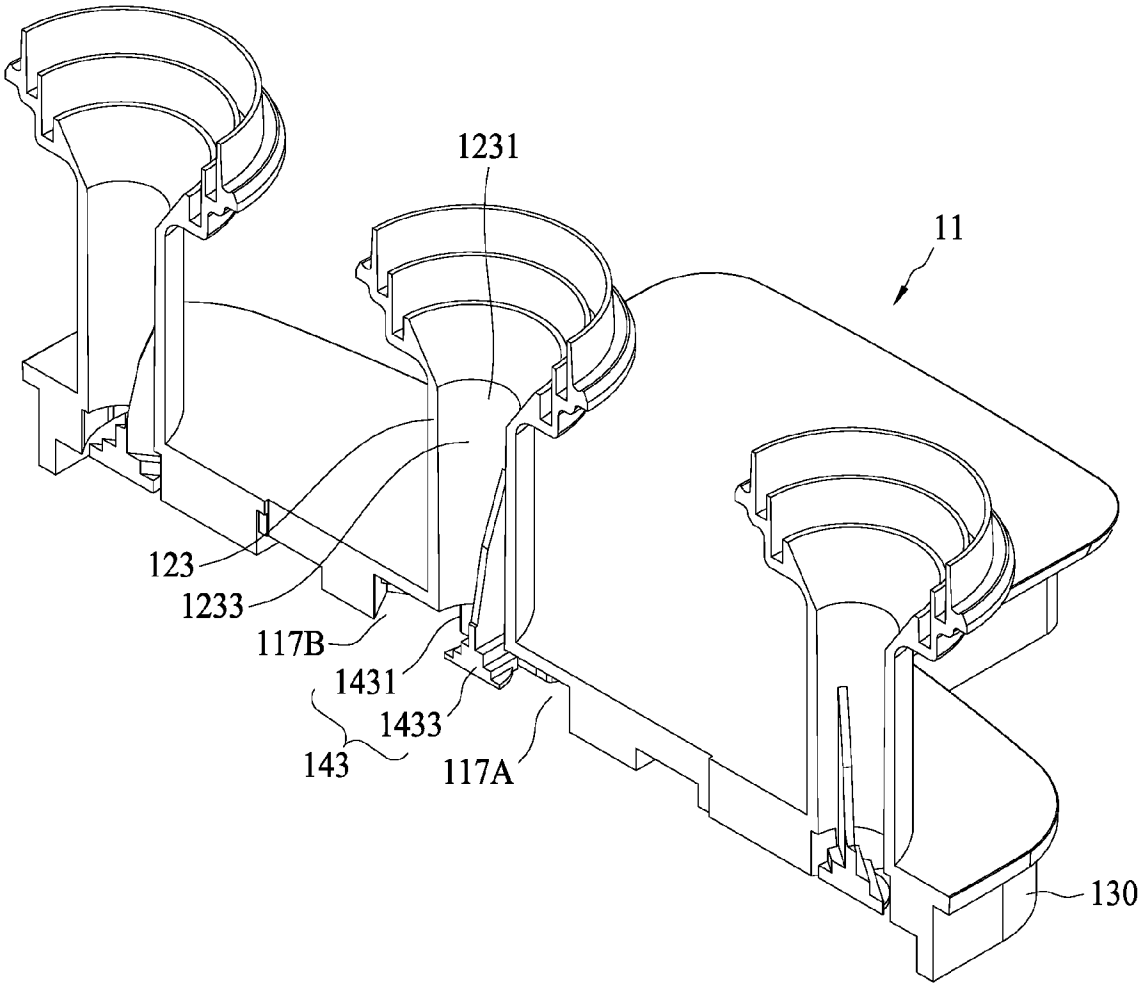
FIG. 5 illustrates a cross-sectional full view of the housing in FIG. 2 along another direction according to some embodiments of the present disclosure.

FIG. 2 and FIG. 3 illustrate disassembled views of the LNB down-converter 10 from the top side and the bottom side, respectively, according to some embodiments of the present disclosure; FIG. 4 illustrates a cross-sectional full view of the housing 11 along one direction according to some embodiments of the present disclosure; and FIG. 5 illustrates a cross-sectional full view of the housing 11 along another direction according to some embodiments of the present disclosure.

In some embodiments of the present disclosure, the LNB down-converter 10 comprises a housing 11, a metal sheet 15, and a circuit board 17. In some embodiments of the present disclosure, the housing 11 includes a base 111 having an upper surface 111A, a bottom surface 111B, and a depression 113A dented along a direction from the bottom surface 111B to the upper surface 111A; a feed horn structure 120 protruding from the upper surface 111A; a wall 130 protruding from the bottom surface 111B and forming a housing cavity 131 under the bottom surface 111B; a first transforming structure 141 positioned at a first end of the depression 113A; and a second transforming structure 142 positioned at a second end of the depression 113A.

Referring to FIG. 2, in some embodiments of the present disclosure, the feed horn structure 120 can be implemented in multiple feed horns for receiving microwave signals from multiple satellites; for example, by two first feed horns 121 and a second feed horn 123 disposed in parallel to and between the two first feed horns 121. In some embodiments of the present disclosure, the feed horn structure 120 can be implemented in a single feed horn, such as the first feed horn 121 or the second feed horn 123, for receiving microwave signals from a single satellite. In some embodiments of the present disclosure, the feed horn structure 120 can be implemented in two feed horns for receiving microwave signals from different satellites; for example, by a first feed horn 121 and a second feed horn 123 disposed in parallel to the first feed horn.

Referring to FIG. 3, in some embodiments of the present disclosure, corresponding to the first feed horn 121, the base 111 includes a depression 113A and a depression 113B, where the depression 113A extends from a first side of the first transforming structure 141 and the depression 113B extends from a second side of the first transforming structure 141. In some embodiments of the present disclosure, the bottom of the first transforming structure 141 is substantially at the same level as the bottom surface 111B. In some embodiments of the present disclosure, the depression 113A extends from one side of the first transforming structure 141 to one of the second transforming structures 142, and the depression 113B extends from another side of the first transforming structure 141 to another second transforming structure 142. In some embodiments of the present disclosure, the second transforming structure 142 has a multi-step member extending from the bottom of the depression 117A (or the depression 117B) to the bottom surface 111B.

Referring to FIG. 3, in some embodiments of the present disclosure, corresponding to the second feed horn 123, the base 111 includes a depression 117A and a depression 117B, where the depression 117A extends from a first side of the first transforming structure 143 and the depression 117B extends from a second side of the first transforming structure 143. In some embodiments of the present disclosure, the bottom of the first transforming structure 143 is substantially at the same level as the bottom surface 111B. In some embodiments of the present disclosure, the depression 117A extends from one side of the first transforming structure 143 to one of the second transforming structures 144, and the depression 117B extends from another side of the first transforming structure 143 to another second transforming structure 144. In some embodiments of the present disclosure, the second transforming structure 144 has a multi-step member extending from the bottom of the depression 117A (or the depression 117B) to the bottom surface 111B.

In some embodiments of the present disclosure, corresponding to the first feed horn 121, the metal sheet 15 substantially covers the depressions 113A, 113B to implement waveguides 115A, 115B for propagating microwave signals, respectively. In some embodiments of the present disclosure, the metal sheet 15 has an aperture 151 at least exposing a portion of the second transforming structure 142, and the aperture 151 serves as a transmission port for propagating microwave signals between the waveguides 115A, 115B and the circuit board 17. In some embodiments of the present disclosure, the metal sheet 15 covers the depression 113A to implement an E-plane waveguide for propagating microwave signals.

In some embodiments of the present disclosure, corresponding to the second feed horn 123, the metal sheet 15 substantially covers the depressions 117A, 117B to implement waveguides 119A, 119B for propagating microwave signals. In some embodiments of the present disclosure, the metal sheet 15 has an aperture 153 exposing at least a portion of the second transforming structure 144, and the aperture 153 serves as a transmission port for propagating microwave signals between the waveguides 119A, 119B and the circuit board 17.

In some embodiments of the present disclosure, the circuit board 17 is positioned within the housing cavity 131, wherein the circuit board 17 has a slot 171 corresponding to the aperture 151, a slot 173 corresponding to the aperture 153, and receiving pins 172 extending into the slot 171 and the slot 173, wherein the receiving pins 172 are configure to receive the microwave signals propagating in the waveguides 115A, 115B, 119A, 119B and transmit the received signals to an input of an amplifier on the circuit board 17. In some embodiments of the present disclosure, the housing 11 further comprises a spacer 19 covering the circuit board 17 on the metal sheet 15. In some embodiments of the present disclosure, the circuit board 17 is smaller than the metal sheet 15. In some embodiments of the present disclosure, the receiving pin 172 can be implemented in a transmission line, and an I-shaped pin for an E-plan waveguide.

In some embodiments of the present disclosure, the feed horn structure 120 can be implemented in a single feed horn, such as the first feed horn 121 (or the second feed horn 123), and correspondingly there is one first transforming structure (in the housing 11), one pair of depressions (in the housing 11), one pair of second transforming structures (in the housing 11), and one pair of apertures (in the circuit board 17). In some embodiments of the present disclosure, the feed horn structure 120 is implemented in three feed horns (two first feed horns 121 and one second feed horn 123), and there are three pairs of depressions (in the housing 11), three pairs of second transforming structures (in the housing 11), and three pairs of apertures in the circuit board 17

In some embodiments of the present disclosure, the aperture 151 of the metal sheet 15 is rectangular, and the other shape, such as a half circle, can be used to implement the aperture 151. Similarly, in some embodiments of the present disclosure, the slot 171 of the circuit board 17 is rectangular, and the other shape, such as a half circle, can be used to implement the slot 171.

Referring to FIG. 4, in some embodiments of the present disclosure, the first feed horn 121 includes a horn cavity 1211 implementing a waveguide 1213 communicating with the waveguide 115A implemented in the depression 113A through the first transforming structure 141. In some embodiments of the present disclosure, corresponding to the first feed horn 121, the first transforming structure 141 has a first portion extending into the horn cavity 1211 of the first feed horn 121 and a second portion extending into the depressions 113A, 113B. In some embodiments of the present disclosure, the first transforming structure 141 has a plate 1411 extending into the horn cavity 1211 of the first feed horn 121 and a multi-step member 1413 extending into the depressions 113A, 113B. Referring back to FIG. 3, the second transforming structure 142 corresponding to the first feed horn 121 has a multi-step member at the end of the depression 113A. In some embodiments of the present disclosure, from the top of the plate 1411, the horn cavity 1211 of the first feed horn 121 is separated into two partitions, and the multi-step member 1413 has two multi-step portions corresponding to the two partitions.

Referring to FIG. 5, in some embodiments of the present disclosure, the second feed horn 123 includes a horn cavity 1231 implementing a waveguide 1233 communicating with the waveguide 119A implemented in the depression 117A through the first transforming structure 143. In some embodiments of the present disclosure, corresponding to the second feed horn 123, the first transforming structure 143 has a first portion extending into the horn cavity 1231 of the second feed horn 123 and a second portion extending into the depressions 117A, 117B. In some embodiments of the present disclosure, the first transforming structure 143 has a plate 1431 extending into the horn cavity 1231 of the second feed horn 123 and a multi-step member 1433 extending into the depressions 117A, 117B. Referring back to FIG. 3, the second transforming structure 144 corresponding to the second feed horn 123 has a multi-step member at the end of the depression 117A. In some embodiments of the present disclosure, from the top of the plate 1431, the horn cavity 1231 of the second feed horn 123 is separated into two partitions, and the multi-step member 1433 has two multi-step portions corresponding to the two partitions.

Figure 6:
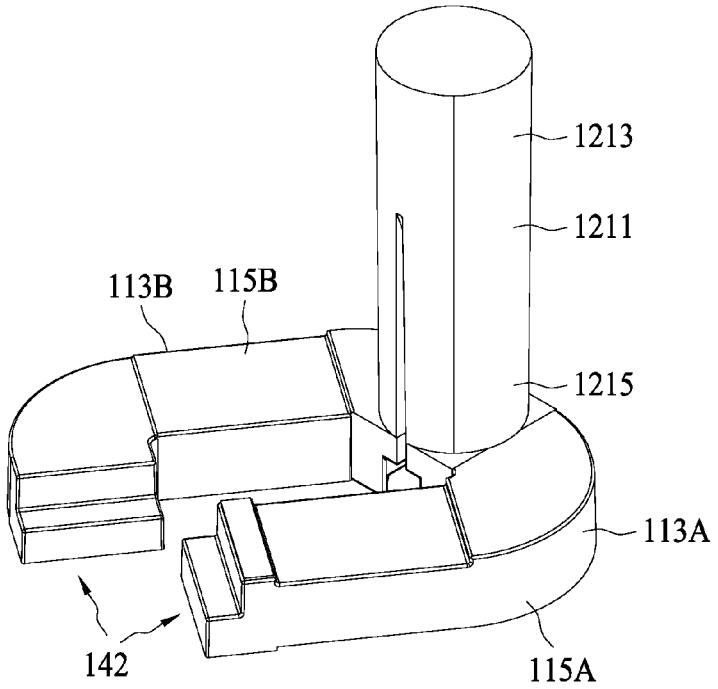
FIG. 6 and FIG. 7 illustrate a full view of the waveguides corresponding to the first feed horn at different view angles according to some embodiments of the present disclosure.
Figure 7:
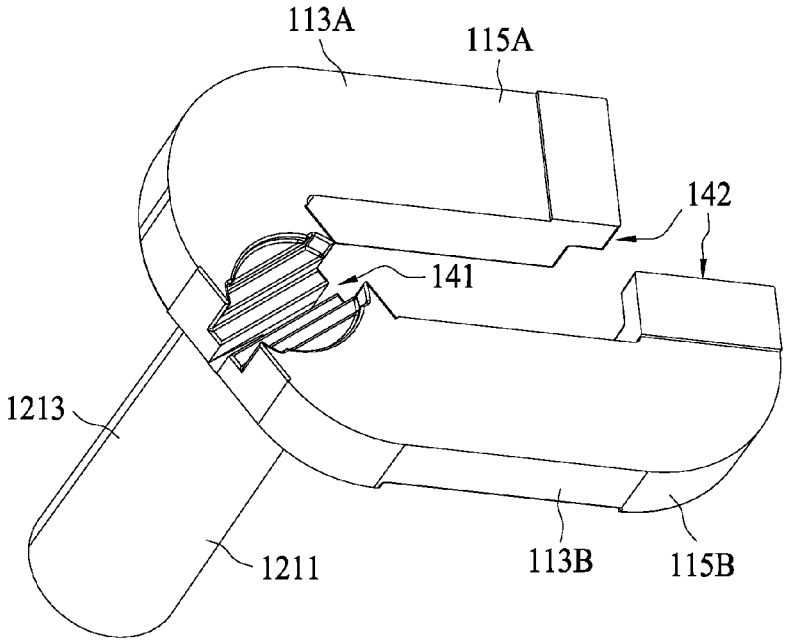

FIG. 6 and FIG. 7 illustrate a full view of the waveguides 115A, 115B corresponding to the first feed horn 121 at different view angles according to some embodiments of the present disclosure. As shown in FIG. 6 and FIG. 7, in some embodiments of the present disclosure, the waveguide 1213 implemented in the horn cavity 1211 has a bottom 1215 communicating with the waveguide 115A implemented in the depression 113A; the first transforming structure 141 is at the bottom 1215 of the horn cavity 1211 of the first feed horn 121; the depression 113A and the waveguide 115A extends from a first side of the bottom 1235 and are disposed between one side of the first transforming structure 141 and one of the second transforming structures 142; and the depression 113B and the waveguide 115B extends from a second side of the bottom 1235 and are disposed between another side of the first transforming structure 141 and another second transforming structure 142.

In some embodiments of the present disclosure, the first transforming structure 141 has a first multi-step portion facing the depression 113A and a second multi-step portion facing the depression 113B. In some embodiments of the present disclosure, the waveguide 1213 implemented in the horn cavity 1211 is substantially not in parallel, e.g. perpendicular, to the waveguides 115A, 115B implemented in the depressions 113A, 113B. In some embodiments of the present disclosure, the waveguide 1213 implemented in the horn cavity 1211 is substantially tilted to the waveguides 115A, 115B implemented in the depressions 113A, 113B, and the tilted angle depends on the position of the satellite sending the microwave signals.

Figure 8:
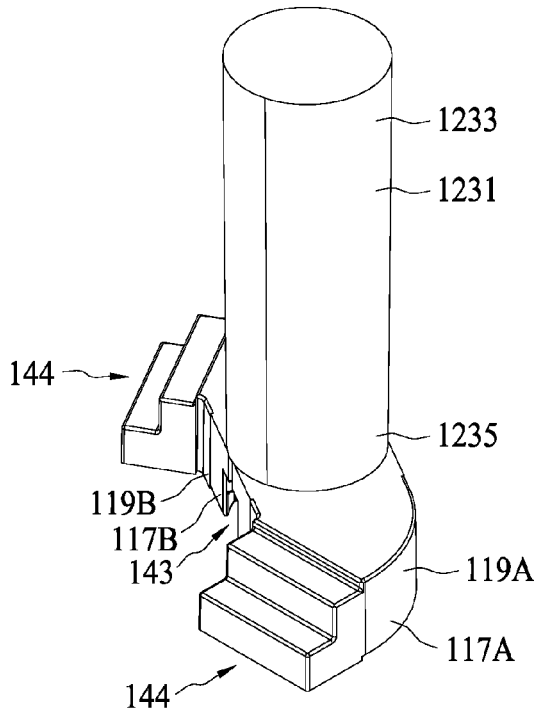
FIG. 8 and FIG. 9 illustrate a full view of the waveguides corresponding to the second feed horn at different view angles according to some embodiments of the present disclosure.
Figure 9:
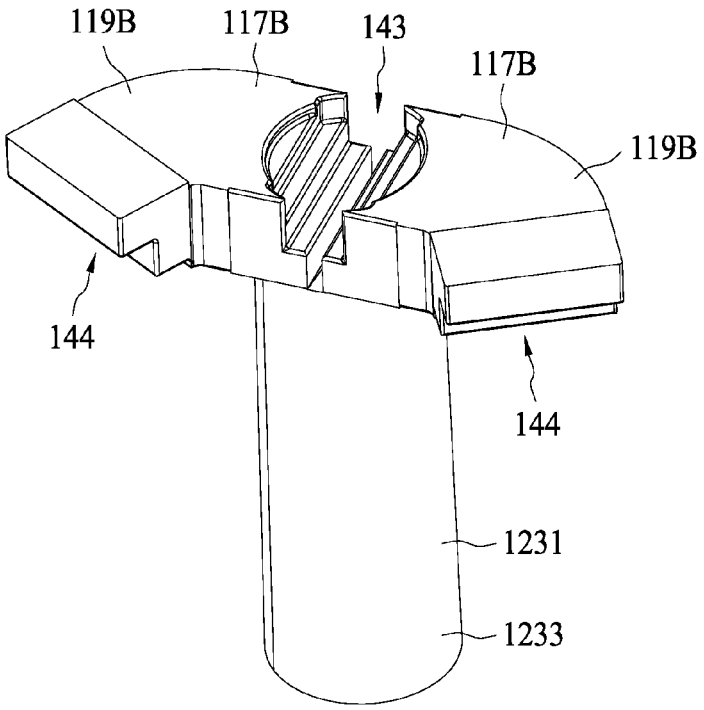

FIG. 8 and FIG. 9 illustrate a full view of the waveguides 119A, 119B corresponding to the second feed horn 123 at different view angles according to some embodiments of the present disclosure. As shown in FIG. 8 and FIG. 9, in some embodiments of the present disclosure, the waveguide 1233 implemented in the horn cavity 1231 has a bottom 1235 communicating with the waveguide 119A implemented in the depression 113A; the first transforming structure 143 is at the bottom 1235 of the horn cavity 1231 of the first second feed horn 123; the depression 117A and the waveguide 119A extend from a first side of the bottom 1235 and are disposed between one side of the first transforming structure 143 and one of the second transforming structures 144; and the depression 117B and the waveguide 119B extend from a second side of the bottom 1235 and are disposed between another side of the first transforming structure 143 and another second transforming structure 144.

In some embodiments of the present disclosure, the first transforming structure 143 has a first multi-step portion facing the depression 117A and a second multi-step portion facing the depression 117B. In some embodiments of the present disclosure, the waveguide 1233 implemented in the horn cavity 1231 is substantially not in parallel, e.g. perpendicular, to the waveguides 119A, 119B implemented in the depressions 117A, 117B. In some embodiments of the present disclosure, the waveguide 1233 implemented in the horn cavity 1231 is substantially tilted to the waveguides 119A, 119B implemented in the depressions 117A, 117B, and the tilted angle depends on the position of the satellite sending the microwave signals.

Figure 10:
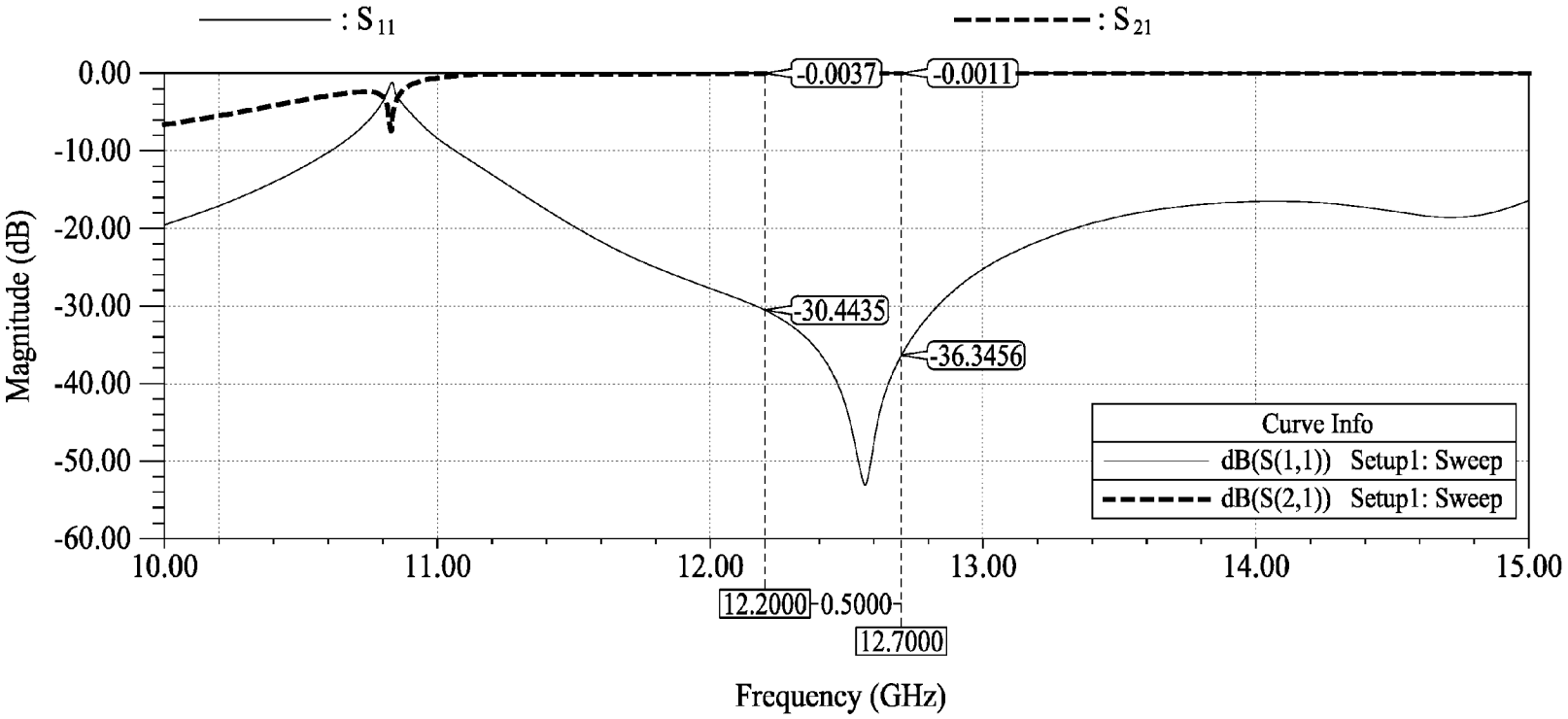
FIG. 10 illustrates a frequency response diagram of the waveguide between the first feed horn and the circuit board according to some embodiments of the present disclosure.

FIG. 10 illustrates a frequency response diagram of the waveguide 115A between the first feed horn 121 and the circuit board 17 according to some embodiments of the present disclosure. In some embodiments of the present disclosure, the waveguides (115A, 115B, 119A, 119B) between the feed horns (121, 123) and the input of the circuit board 17 serves as filters such as a band pass filter, a high pass filter, a low pass filter, or a band stop filter. As shown in FIG. 10, in some embodiments of the present disclosure, the insertion loss ($S_{21}$) is between −0.0037 and −0.0011 dB in a range from 12.2 GHz to 12.7 GHz and the return loss ($S_{11}$) is between −30.4435 and −36.3456 dB in a range from 12.2 GHz to 12.7 GHz (Ku band); in other words, the waveguide 115A between the first feed horn 121 and the circuit board 17 has a pass-band in a range from 12.2 GHz to 12.7 GHz (Ku band).

Figure 11:
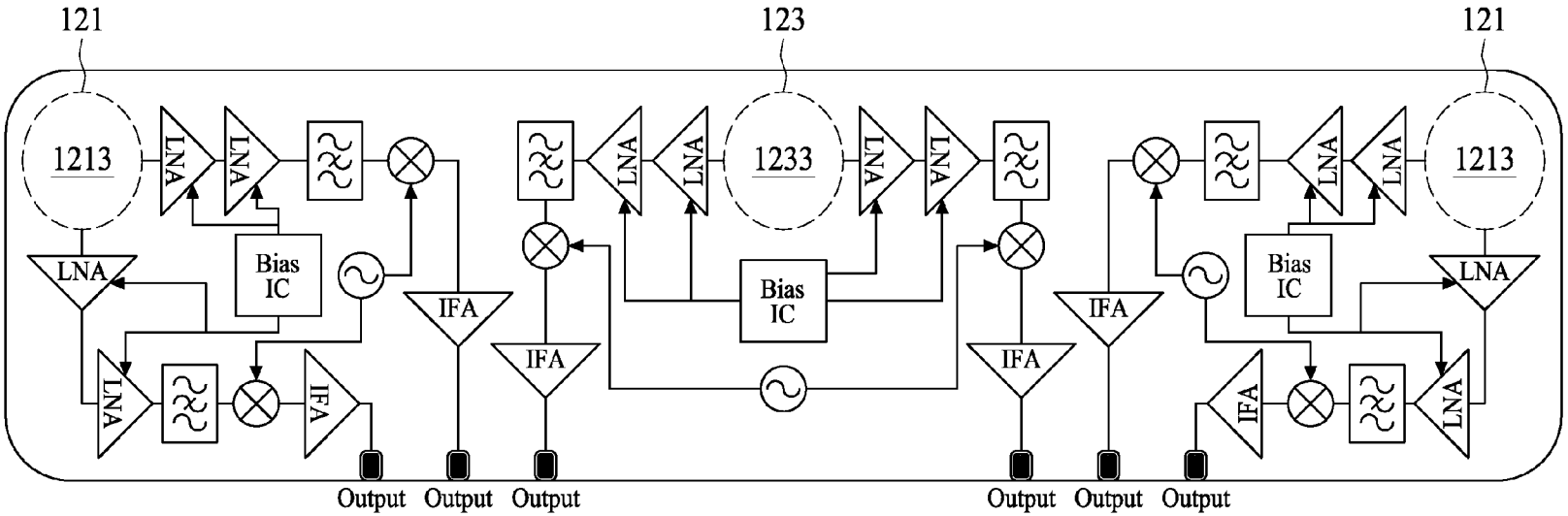
FIG. 11 illustrates a schematic view of a comparative circuit board.

FIG. 11 illustrates a schematic view of a comparative circuit board 17'. As shown in FIG. 11, the comparative circuit board 17' uses many discrete electronic devices such as low noise amplifier (LNA), filters, intermediate frequency amplifiers (IFA), mixers, and local-oscillators (Lo). In addition, the feed horns 121 and 123 (shown in dash lines) for receiving microwave signals from the satellites need to be separated by a certain distance. As a result, the comparative circuit board needs a large layout size (space) to comply with the positions of the separated feed horns and to position the discrete electronic devices.

Figure 12:
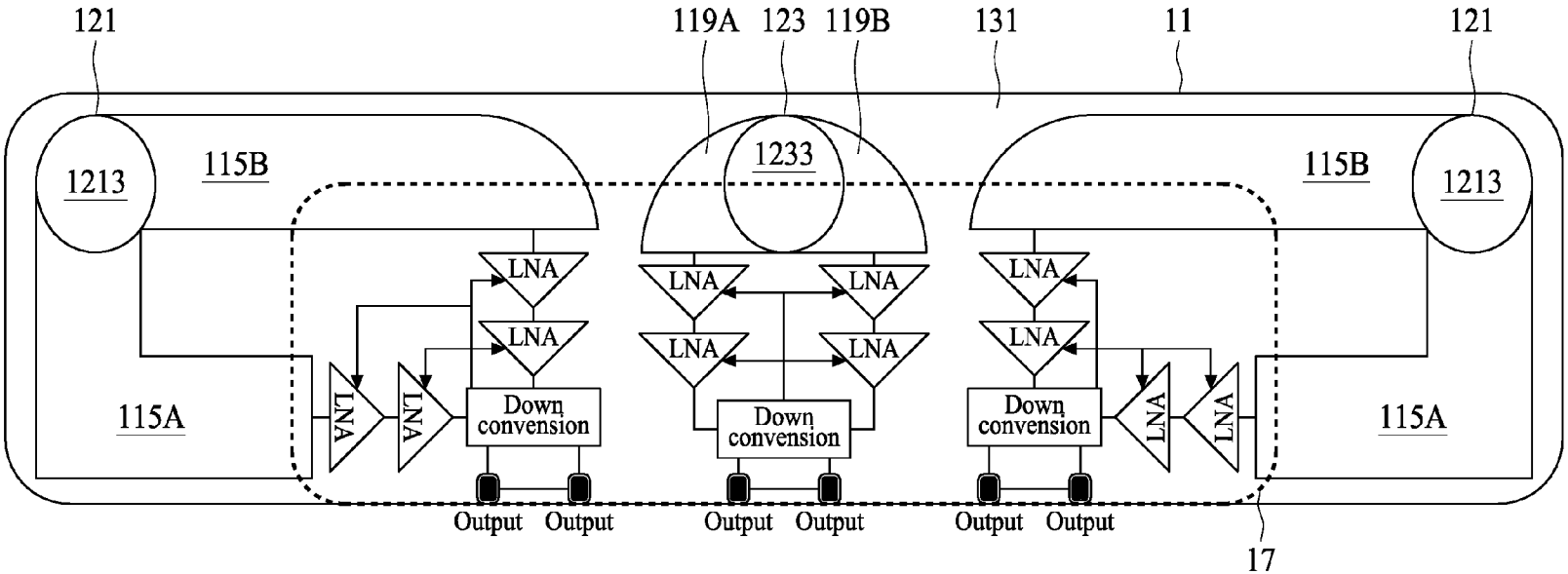
FIG. 12 illustrates a schematic view of the housing and the circuit board according to some embodiments of the present disclosure.

FIG. 12 illustrates a schematic view of the housing 11 and the circuit board 17 according to some embodiments of the present disclosure. In some embodiments of the present disclosure, the circuit board 17 comprises integrated circuit devices, such as the low noise amplifier (LNA) and down conversion circuit, between the waveguides (115A, 115B, 119A, 119B) of the housing 11 and the output of the circuit board 17. In some embodiments of the present disclosure, the waveguides (115A, 115B, 119A, 119B) between the feed horns (121, 123) and the input of the circuit board 17 (the input of the low noise amplifier) implement some functions of the discrete electronic devices, such as the filters on the comparative circuit board 17', and the layout size of the circuit board 17 can be correspondingly reduced to be smaller than the housing cavity 131 as compared with the comparative circuit board 17'.

In some embodiments of the present disclosure, the waveguide 115A has a first end communicating with the waveguide 1213 implemented in the horn cavity 1211 of the feed horn 121, and the circuit board 17 is positioned in the housing 11 substantially without overlapping the first end; and the waveguide has a second end communicating with the circuit board 17, and the circuit board 17 substantially overlaps the second end.

Figure 13:
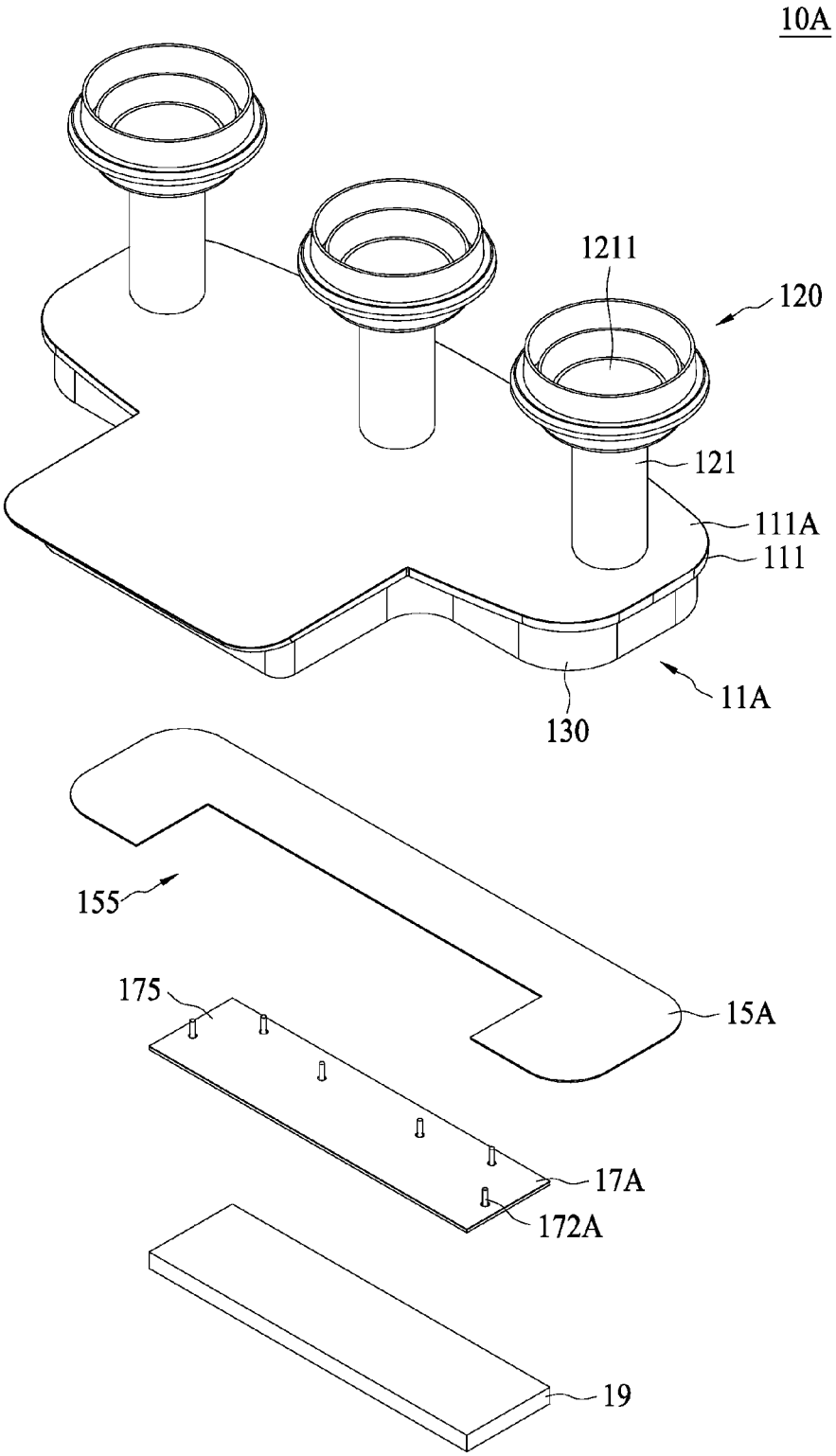
FIG. 13 and FIG. 14 illustrate disassembled views of the low noise block down-converter from the top side and the bottom side, respectively, according to some embodiments of the present disclosure.
Figure 14:
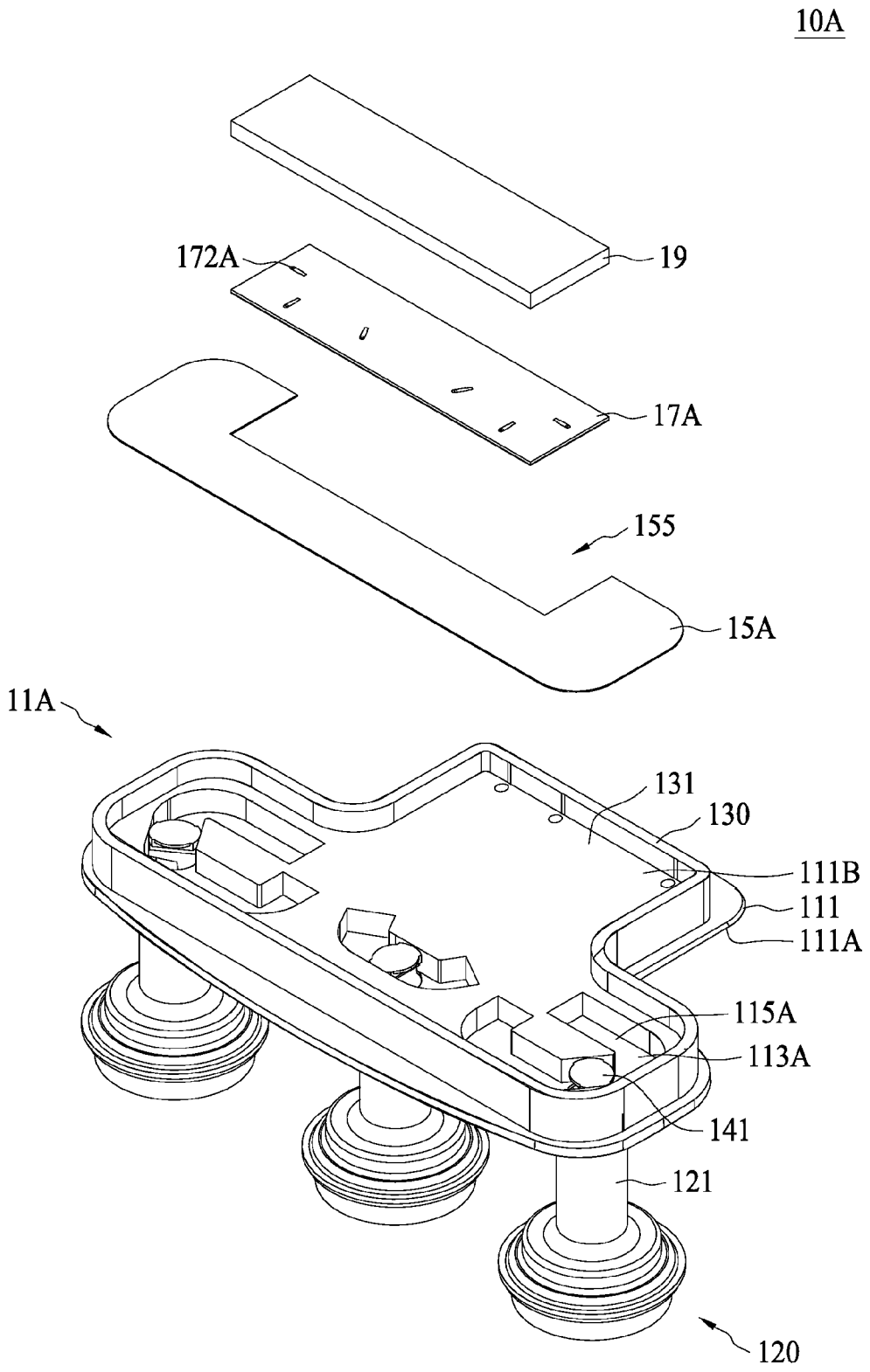

FIG. 13 and FIG. 14 illustrate disassembled views of the LNB down-converter 10A from the top side and the bottom side, respectively, according to some embodiments of the present disclosure. In some embodiments of the present disclosure, the LNB down-converter 10A with a waveguide transition structure for receiving satellite signals comprises a housing 11A, a metal sheet 15A, and a circuit board 17A. In some embodiments of the present disclosure, the circuit board 17A includes a plurality of I-shaped receiving pins 172A each extending into the second waveguide.

In some embodiments of the present disclosure, the housing 11A includes a base 111 having an upper surface 111A, a bottom surface 111B, and a depression 113A dented along a direction from the bottom surface 111B to the upper surface 111A; a feed horn structure 120 protruding from the upper surface 111A; a wall 130 protruding from the bottom surface 111B and forming a housing cavity 131 under the bottom surface 111B; and a first transforming structure 141 positioned at a first end of the depression 113A. The housing 11A in FIG. 14 is substantially the same as the housing 11 in FIG. 3, except that the housing 11A in FIG. 14 does not have a second transforming structure at the second end of the depression 113A. In some embodiments of the present disclosure, the metal sheet 15A covers a portion of the depression 113A, and a metal layer 175 such as a ground layer of the circuit board 17A covers a portion of the depression 113A, so as to implement a waveguide 115A in the housing 11A.

In some embodiments of the present disclosure, the metal sheet 15A has a concave 155, and the size of the circuit board 17A is substantially the same as that of the concave 155, such that the metal sheet 15A and the metal layer 175 of the circuit board 17A substantially covers the entire depression 113A to implement the waveguide 115A. In some embodiments of the present disclosure, the size of the circuit board 17A can be optionally increased such that the metal layer 175 is correspondingly increased to substantially cover the entire depression 113A, and the metal sheet 15A can be omitted.

Figure 15:
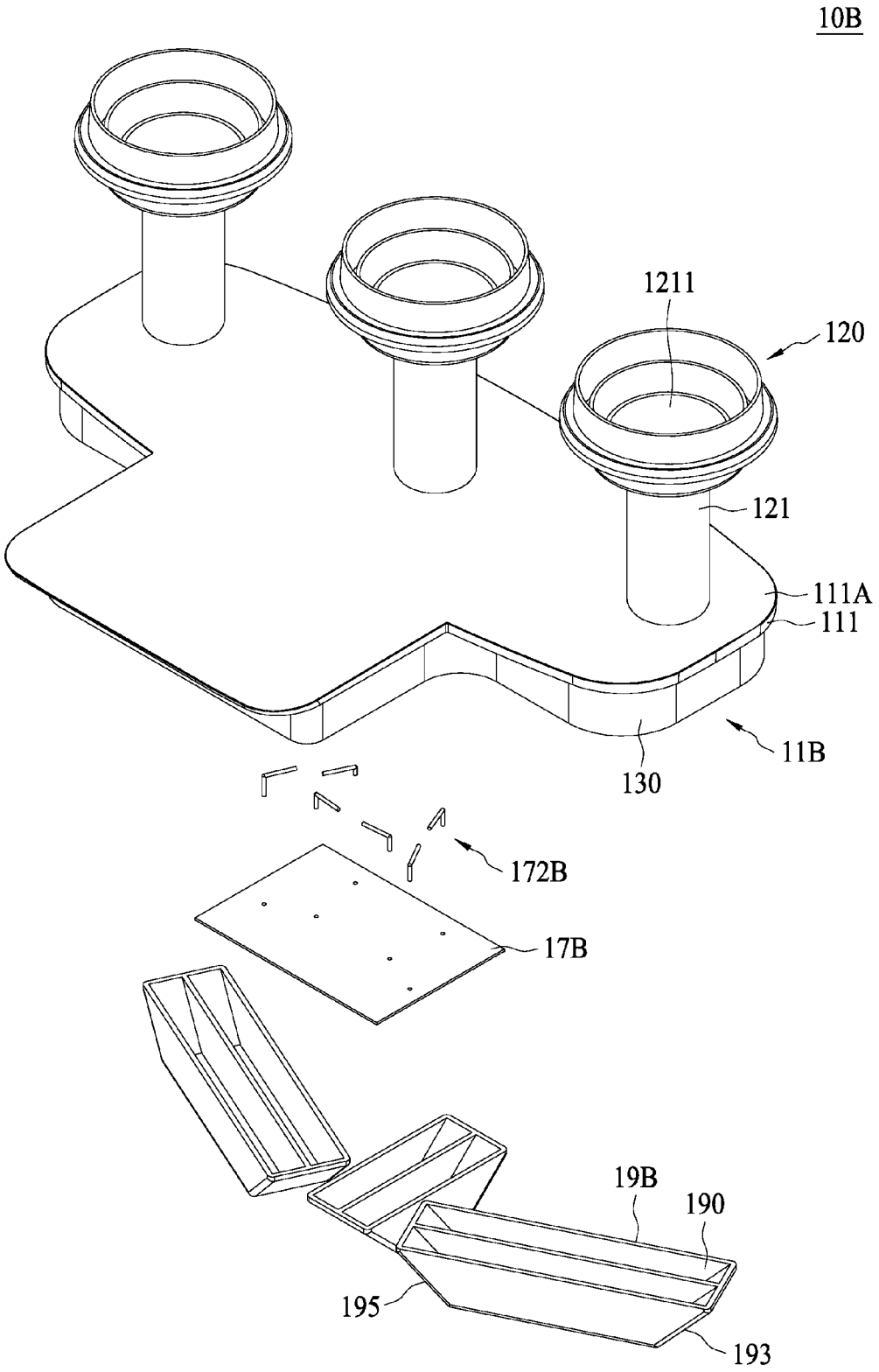
FIG. 15 and FIG. 16 illustrate disassembled views of the low noise block down-converter from the top side and the bottom side, respectively, according to some embodiments of the present disclosure.
Figure 16:
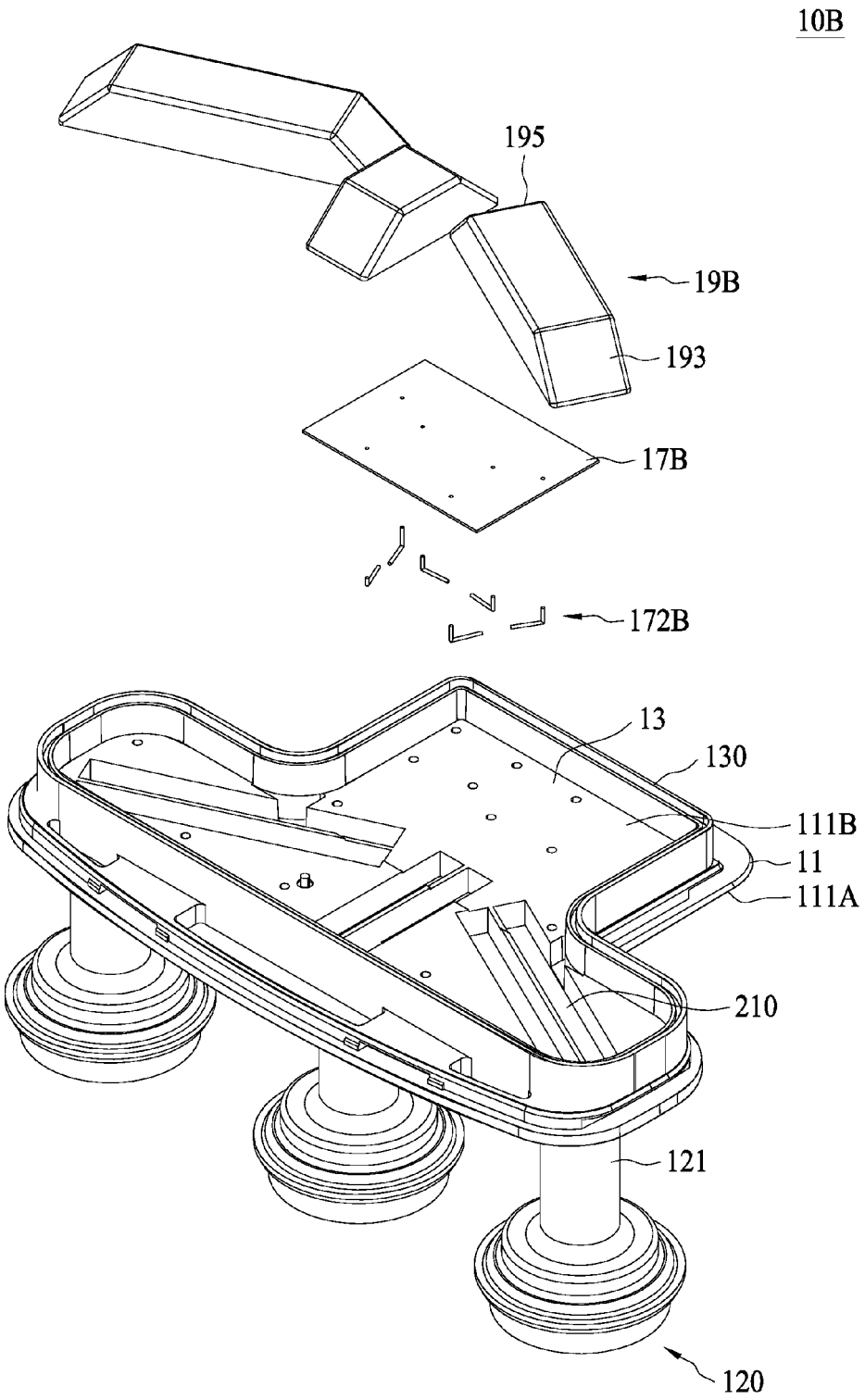

FIG. 15 and FIG. 16 illustrate disassembled views of the LNB down-converter 10B from the top side and the bottom side, respectively, according to some embodiments of the present disclosure. In some embodiments of the present disclosure, the LNB down-converter 10B with a waveguide transition structure for receiving satellite signals comprises a housing 11B, a circuit board 17B, and a metal part 19B, wherein the housing 11B and the metal part 19B form an H-plane waveguide for propagating microwave signals.

In some embodiments of the present disclosure, the housing 11B includes a base 111 having an upper surface 111A, a bottom surface 111B, and a first depression 210 dented along a direction from the bottom surface 111B to the upper surface 111A; a feed horn structure 120 protruding from the upper surface 111A; and a wall 130 protruding from the bottom surface 111B and forming a housing cavity 131 under the bottom surface 111B In some embodiments of the present disclosure, the metal part 19B substantially covering the first depression 210 and has a second depression 190 communicating with the first depression 210. In some embodiments of the present disclosure, the feed horn 121 has a first waveguide implemented in the horn cavity 1211, and the housing 11B has a second waveguide implemented in the first depression 210 and the second depression 190, and the microwave signals are transmitted from the satellite to the circuit board via the first waveguide, and the second waveguide. In some embodiments of the present disclosure, the second waveguide is substantially not in parallel to the first waveguide. In some embodiments of the present disclosure, the second waveguide is substantially tilted to the first waveguide, and the tilted angle depends on the position of the satellite sending the microwave signals.

In some embodiments of the present disclosure, the circuit board 17B is positioned between the base 111 and the metal part 19B. In some embodiments of the present disclosure, the circuit board 17B includes a plurality of L-shaped receiving pins 172B each having a lateral segment disposed on the circuit board 17B and a vertical segment extending into the second waveguide.

In some embodiments of the present disclosure, the metal part 19B has a first slanted plane 193 configured to guide microwave signals from the first waveguide to the second waveguide. In some embodiments of the present disclosure, the metal part 19B further has a second slanted plane 195 configured to guide microwave signals from the second waveguide to the circuit board 17B. In some embodiments of the present disclosure, the H-plane waveguide is implemented in the first depression 210 and the second depression 190 for propagating microwave signals.

In some embodiments of the present disclosure, a low noise block down-converter with a waveguide transition structure for receiving satellite signals includes a feed horn structure having at least a first waveguide extending along a first direction, a housing having at least a second waveguide extending along a second direction and communicating with the first waveguide, wherein the second direction is substantially not in parallel to the first direction; and a circuit board positioned within the housing, wherein the circuit board has a receiving pin configure to receive the microwave signals propagating in the second waveguide.

In some embodiments of the present disclosure, an outdoor unit includes a dish antenna and a low noise block down-converter positioned at a focus point of the dish antenna. In some embodiments of the present disclosure, the low noise block down-converter with a waveguide transition structure for receiving satellite signals includes a feed horn structure having at least a first waveguide extending along a first direction, a housing having at least a second waveguide extending along a second direction and communicating with the first waveguide, wherein the second direction is substantially not in parallel to the first direction; and a circuit board positioned within the housing, wherein the circuit board has a receiving pin configure to receive the microwave signals propagating in the second waveguide.

In a comparative low noise block down-converter, the feed horns need to be separated by a certain distance and discrete electronic devices are used to implement the microwave receiving system. The comparative low noise block down-converter uses a circuit board with a large layout size (space) to comply with the positions of the separated feed horns and to position the discrete electronic devices. It is well known in the art that the circuit board for implementing the microwave receiving system is very expensive, and thus the overall cost of the comparative low noise block down-converter is very expensive as well.

As the industrial tends to implement the functions of several discrete electronic devices into a single integrated circuit device, the low noise block down-converter with a waveguide transition structure for receiving satellite signals of the present disclosure uses the waveguide in the housing in order to guide the microwave signals from the feed horn to the input port of the circuit board such as the input port of the low noise amplifier. As a result, an integrated circuit device implementing the function of several discrete electronic devices can be used on the circuit board, thus allowing the low noise block down-converter with a waveguide transition structure for receiving satellite signals of the present disclosure to reduce the layout size of the circuit board and, in turn, dramatically reducing the cost of the low noise block down-converter.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A low noise block down-converter with a waveguide transition structure for receiving satellite signals, comprising:

a feed horn structure having at least a first waveguide extending along a first direction;

a housing having at least a second waveguide extending along a second direction and communicating with the first waveguide, wherein the second direction is substantially not in parallel to the first direction; and a circuit board positioned within the housing, wherein the circuit board has a receiving pin configure to receive microwave signals propagating in the second waveguide;

wherein the housing comprises a first transforming structure configured to guide the microwave signals from the first waveguide to the second waveguide;

wherein the first transforming structure has a first portion in the feed horn structure and a second portion in the depression.

2. The low noise block down-converter of claim 1, wherein the housing comprises:

a base having an upper surface, a bottom surface, and a depression dented from the bottom surface towards the upper surface; and a metal sheet substantially covering the depression to implement the second waveguide.

3. The low noise block down-converter of claim 2, wherein the metal sheet has an aperture exposing at least a portion of the second waveguide, the circuit board has a slot corresponding to the aperture, and the receiving pin extends into the slot.

4. The low noise block down-converter of claim 1 wherein the first transforming structure has a multi-step member.

5. The low noise block down-converter of claim 1, wherein the housing comprises;

a base having an upper surface, a bottom surface, and a depression dented from the bottom surface towards the upper surface; and a metal layer disposed on the circuit board, wherein the metal layer at least covers a portion the depression to implement at least a portion of the second waveguide.

6. The low noise block down-converter of claim 5, wherein the housing comprises:

a metal sheet covering at least covers a portion the depression to implement at least a portion of the second waveguide, and the metal sheet and the metal layer substantially cover the depression.

7. The low noise block down-converter of claim 1, wherein the second waveguide has a first end communicating with the first waveguide, and the circuit board is positioned substantially without overlapping the first end.

8. The low noise block down-converter of claim 7, wherein the second waveguide has a second end communicating with the circuit board, and the circuit board substantially overlaps the second end.

9. The low noise block down-converter of claim 1, wherein the first waveguide has a bottom communicating with the second waveguide, and the housing includes a first depression extending from a first side of the bottom and a second depression extending from a second side of the bottom.

10. The low noise block down-converter of claim 1, wherein the feed horn structure comprises a first feed horn and a second feed horn disposed in parallel to the first feed horn.

11. A low noise block down-converter, with a waveguide transition structure for receiving satellite signals, comprising:

a feed horn structure having at least a first waveguide extending along a first direction;

a housing having at least a second waveguide extending along a second direction and communicating with the first waveguide, wherein the second direction is substantially not in parallel to the first direction; and a circuit board positioned within the housing, wherein the circuit board has a receiving pin configure to receive microwave signals propagating in the second waveguide;

wherein the housing comprises a second transforming structure configured to guide the microwave signals from the second waveguide to the circuit board;

wherein the second transforming structure has a multi-step member.

12. A low noise block down-converter, with a waveguide transition structure for receiving satellite signals, comprising:

a feed horn structure having at least a first waveguide extending along a first direction;

a housing having at least a second waveguide extending along a second direction and communicating with the first waveguide, wherein the second direction is substantially not in parallel to the first direction; and a circuit board positioned within the housing, wherein the circuit board has a receiving pin configure to receive microwave signals propagating in the second waveguide;

wherein the housing comprises:

a base having an upper surface, a bottom surface, and a first depression dented from the bottom surface towards the upper surface; and a metal part substantially covering the first depression to implement the second waveguide, wherein the metal part has a second depression communicating with the first depression;

wherein the circuit board is positioned between the base and the metal part.

13. The low noise block down-converter of claim 12, wherein the metal part has a first slanted plane configured to guide the microwave signals from the first waveguide to the second waveguide.

14. The low noise block down-converter of claim 13, wherein the metal part has a second slanted plane configured to guide the microwave signals from the second waveguide to the circuit board.

15. A low noise block down-converter with a waveguide transition structure for receiving satellite signals, comprising:

a feed horn structure having at least a first waveguide extending along a first direction;

a housing having at least a second waveguide extending along a second direction and communicating with the first waveguide, wherein the second direction is substantially not in parallel to the first direction; and a circuit board positioned within the housing, wherein the circuit board has a receiving pin configure to receive microwave signals propagating in the second waveguide;

wherein the receiving pin extends into the second waveguide.

* * * * *